United States Patent [19]

Davich et al.

[11] Patent Number: 4,509,428

[45] **Date of Patent: * Apr. 9, 1985**

[54] SHOTSHELL CASING WITH PARTIALLY TELESCOPED BASEWAD

[75] Inventors: Luke J. Davich; Jack A. Erickson, both of Anoka; Richard W. Proulx, Forest Lake, all of Minn.

[73] Assignee: Federal Cartridge Corporation, Minneapolis, Minn.

[ * ] Notice: The portion of the term of this patent subsequent to Nov. 13, 2001 has been disclaimed.

[21] Appl. No.: 541,808

[22] Filed: Oct. 13, 1983

Related U.S. Application Data

[63] Continuation of Ser. No. 224,267, Jan. 16, 1981, abandoned.

[51] Int. Cl.[3] ..... F42B 5/30

[52] U.S. Cl. ..... 102/466; 102/448

[58] Field of Search ..... 102/448, 449, 464–467, 102/469–472

[56] References Cited

U.S. PATENT DOCUMENTS

| | | | |
|---|---|---|---|
| 202,363 | 4/1878 | Moore . | |
| D. 204,608 | 3/1966 | Sobolewski . | |
| 956,201 | 4/1910 | Sherman . | |
| 980,351 | 1/1911 | Sherman et al. . | |
| 2,668,345 | 2/1954 | Eckstein . | |
| 2,823,611 | 2/1958 | Thayer . | |
| 2,829,595 | 4/1958 | Hitchens . | |
| 2,876,496 | 3/1959 | Murphy . | |
| 2,936,709 | 5/1960 | Seavey . | |
| 2,987,798 | 6/1961 | Fromont . | |
| 3,093,073 | 6/1963 | Lockwood et al. . | |
| 3,099,958 | 8/1963 | Daubenspeck et al. . | |
| 3,103,170 | 10/1963 | Covington et al. . | |
| 3,105,439 | 10/1963 | Young, Jr. . | |
| 3,171,350 | 3/1965 | Metcalf . | |
| 3,185,095 | 5/1965 | Mayer et al. . | |
| 3,188,956 | 6/1965 | Helles | 102/466 |
| 3,229,634 | 1/1966 | Moehlman et al. . | |
| 3,233,546 | 2/1966 | Foote et al. . | |
| 3,256,815 | 6/1966 | Davidson et al. . | |
| 3,283,720 | 11/1966 | Foote et al. . | |
| 3,284,560 | 11/1966 | King et al. . | |
| 3,424,089 | 1/1969 | Humpherson . | |
| 3,565,008 | 2/1971 | Gulley . | |
| 3,577,924 | 5/1971 | Findlay et al. . | |
| 3,590,740 | 7/1971 | Herter | 102/466 |
| 3,688,699 | 9/1972 | Horn et al. | 102/461 |
| 3,732,820 | 5/1973 | Hendricks | 102/466 |
| 3,756,156 | 4/1973 | Schuster . | |
| 3,786,755 | 1/1974 | Eckstein et al. . | |
| 3,855,381 | 1/1974 | Eckstein et al. . | |
| 3,929,960 | 12/1975 | Findley et al. | 102/466 |
| 3,995,763 | 12/1976 | Ayres et al. | 220/Dig 14 |
| 4,007,686 | 2/1977 | Hugonet . | |
| 4,065,541 | 12/1977 | Eckstein et al. . | |
| 4,140,058 | 2/1979 | Ballreich . | |
| 4,192,233 | 3/1980 | Dumortier . | |

FOREIGN PATENT DOCUMENTS

| | | |
|---|---|---|
| 458004 | 1/1973 | Australia . |
| 1914511 | 2/1965 | Austria . |
| 1914512 | 2/1965 | Austria . |
| 717301 | 5/1965 | Canada . |
| 809421 | 6/1969 | Canada . |
| 839148 | 4/1970 | Canada . |
| 844328 | 6/1970 | Canada . |
| 1004814 | 2/1977 | Canada . |
| 1066131 | 8/1979 | Canada . |

(List continued on next page.)

*Primary Examiner*—Harold J. Tudor

*Attorney, Agent, or Firm*—Schroeder, Siegfried, Vidas & Arrett

[57] ABSTRACT

A single-piece plastic shotshell casing and method of making same comprising softening one end portion only of a tube of uniformly biaxially oriented high density polyethylene sufficiently for forming and until a dollup is formed, then telescoping only a portion of the dollup into the rigid sidewalls of the tube, and then forming the dollup into a substantially thickened integral transverse base section constituting a head with a longitudinally extending primer opening therein, the base section being substantially biaxially oriented and the rigid sidewalls terminating a substantial distance inwardly from the outer end of the base section.

11 Claims, 5 Drawing Figures

FOREIGN PATENT DOCUMENTS

| | | |
|---|---|---|
| 1961307 | 6/1971 | Fed. Rep. of Germany . |
| 1960355 | 1/1976 | Fed. Rep. of Germany . |
| 973692 | 2/1951 | France . |
| 1094754 | 5/1955 | France . |
| 1170851 | 1/1959 | France . |
| 1182969 | 1/1959 | France . |
| 1325407 | 5/1963 | France . |
| 1428218 | 1/1966 | France . |
| 1492332 | 3/1967 | France . |
| 2126516 | 9/1972 | France . |
| 2168171 | 5/1973 | France . |
| 2270548 | 12/1975 | France . |
| 2287324 | 5/1976 | France . |
| 2317622 | 2/1977 | France . |
| 2330522 | 6/1977 | France . |
| 2350572 | 12/1977 | France . |
| 619925 | 5/1959 | Italy . |
| 659739 | 6/1964 | Italy . |
| 683318 | 2/1965 | Italy . |
| 705327 | 5/1966 | Italy . |
| 469370 | 7/1937 | United Kingdom . |
| 926196 | 5/1963 | United Kingdom . |

SHOTSHELL CASING WITH PARTIALLY TELESCOPED BASEWAD

This is a continuation of application Ser. No. 224,267, filed 1/16/81 now abandoned.

I. DESCRIPTION

BACKGROUND OF THE PRIOR ART

There remains a strong need for an inexpensive, highly reloadable all-plastic one-piece shotshell. One such shotshell is disclosed and claimed in our copending patent application, Ser. No. 117,580 filed by us on Feb. 1, 1980, and entitled ONE-PIECE SHOTSHELL.

Strengthening of sidewalls of thermoplastic tubing by orientation has been known for many years. In 1960, Diedrich disclosed in his U.S. Pat. No. 2,961,711 a method and apparatus for continuously making a biaxially oriented plastic tube which has been commonly used to produce shotshell casings from oriented plastic and has been known as Reifenhauser tubing.

In 1963, Covington et al disclosed in U.S. Pat. No. 3,103,170 a method for making a plastic tube in such a manner as to orient the sidewalls thereof, both axially and circumferentially to thereby greatly strengthen same.

Other U.S. Pat. Nos. such as Larson, 3,492,387; Eckstein, 3,786,755 and 3,855,381; and Sutcliffe, 3,514,468 disclose pertinent methods, apparatus and products but none of them contains a teaching of how to overcome the problems to which our present invention is directed.

Many of the above shotshell casings change shape and size after repeated firing. These changes result from the high pressure gases (generated upon firing) acting on the metal of the head and gradually distorting same, resulting eventually in a requirement for resizing. Since much reloading equipment includes no mechanism for resizing, the casing and head, upon such distortion, become as worthless to a shooter having such equipment as if actual rupture had taken place.

Some shotshell designs have had frequent failure of plastic sidewalls of the casings at the forward edge of the metal head. We have been successful in minimizing that problem by at least partially reversing the sidewalls upon themselves. We have effectively reduced the loss of strength occasioned by reheating of the plastic at that point in the sidewall where the greatest stress is produced by firing and have also eliminated tube growth problems.

BRIEF SUMMARY OF THE INVENTION

To provide an inexpensive single-piece plastic shotshell which can be repeatedly reloaded without failure at the rim of the head and without growth in length, we soften only the very outer end portion of a uniformly biaxially oriented thermoplastic tube section only sufficiently for forming and to create a dollup thereat, then telescope the dollup at least partially within the non-softened sidewalls of the tube, and then form the dollup into a substantially thickened integral biaxially oriented base section which may, of itself, constitute a combined basewad and head. The non-telescoped portion precludes access to the rim of the hot high pressure gases generated upon firing, and thereby obviates failure of the rim of the head or the need for resizing the same, and at the same time precludes growth in length of the casing.

It is a general object of our invention to provide methods and apparatus for manufacturing an improved highly reloadable single-piece all plastic shotshell casing having rigid sidewalls and an integral basewad, each of which is fixed relative to the other and substantially biaxially oriented.

A more specific object is to provide such a one-piece shotshell constructed and arranged to minimize or eliminate, substantial distortions of the head and failure of metal head rims, and plastic-tube failure and longitudinal growth of sidewalls.

BRIEF DESCRIPTION OF THE DRAWINGS

A detailed description of one preferred embodiment of the shotshell casing with partially telescoped basewad is hereafter described with specific reference being made to the drawings in which.

DETAILED DESCRIPTION OF THE INVENTION

Figure 1:
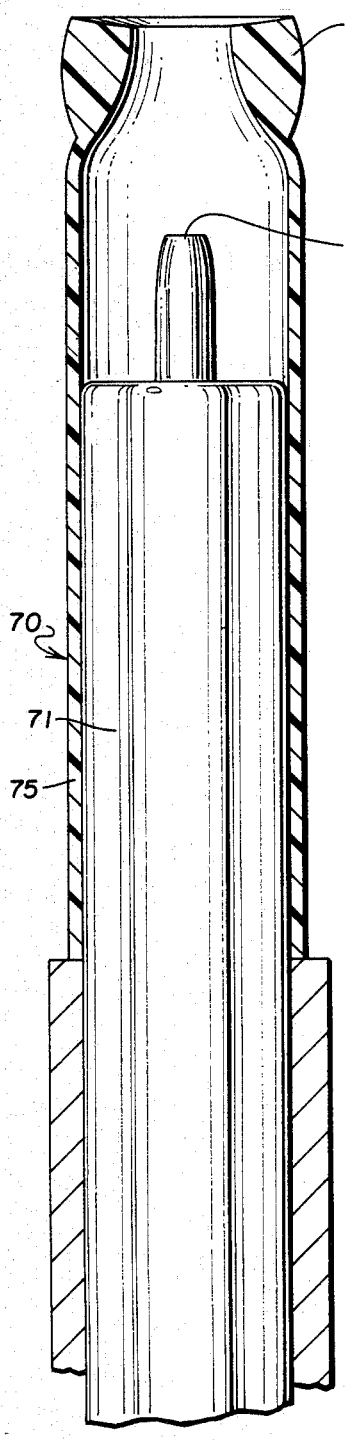
FIG. 1 is a vertical sectional view showing a punch supporting a piece of biaxially oriented Reifenhauser tubing, the upper extreme end of which has been heated until a dollup is formed thereon.

It is preferred that the polymeric materials to be utilized herein be of the crystalline type which, upon being worked, as by being extruded or stretched, undergo crystalline orientation. Orientation of the crystalline structure along the major axis of a shotshell tube of such polymeric materials produces an increase in tensile strength along the axis of the tube. Circumferentially stretching such a tube creates biaxial orientation.

Olefinic polymers such as high density polyethylene and polypropylene having a high degree of crystallinity i.e., at least about 60% to 70%, are particularly preferred polymeric materials for use in this invention.

The most preferred polymeric materials are polyethylene copolymers or ethylene copolymerized with another olefinic such as butene-1 or hexene-1. Generally, however, the materials and characteristic thereof as described in U.S. Pat. No. 3,103,170 to Covington, Jr. et al are satisfactory for this invention. The content of that patent is incorporated herein by reference.

All of the above-described polymeric materials are generally termed herein "crystalline plastics". Such crystalline plastics for shotshell casing may be oriented by providing a length of one-piece cylindrical tubing of crystalline polymer at a temperature approaching, but below its crystalline melting point, and extruding it or stretching it so as to provide longitudinal crystalline orientation therein as is known in the art. For example, see U.S. Pat. No. 3,514,468 to Sutcliffe et al, the contents of which is incorporated herein by reference. Such tubing, if desired as herein, may also be stretched in a radial direction to greatly increase its strength in that direction, as well.

We use a high density polyethylene tube made of material which may be purchased under the brand identification of Soltex Fortiflex Brand B45-06R-09 from Soltex Polymer Corporation, Houston, Texas. The tubing made from this material is stretched both longitudinally and circumferentially in a uniform manner to produce tubing of the desired uniform diameters, the sidewalls of which are straight and of uniform thickness and orientation throughout. The $R_L$ of such tubing is preferably within the range of 4.365–8.150 and its $R_C$ is preferably within the range of 1.056–1.219. $R_L$ is designated as the longitudinal plastic orientation ratio, and $R_C$ is designated as the circumferential plastic orientation ratio, both as defined in U.S. Pat. No. 3,103,170.

We have found that when a shotshell is formed in accordance with our invention, a substantial amount of biaxial orientation is retained within the base section of the casing. Our tests to date indicate that the average $R_L$ of the basewad of such a shell approximates 1.054 and the average $R_C$ approximates 0.8537, when the tube walls from which the basewad is formed have an average $R_L$ approximating 5.25 and an average $R_C$ approximating 1.14. The orientation retained varies somewhat, depending upon the gauge of the casing and the configuration of the basewad, the $R_L$ range found to date being 1.003–1.141 and the $R_C$ range found to date being 0.8298–0.8639.

Shotshell casings produced in the manners described hereinabove have improved characteristics, especially with respect to volume capacity. We have manufactured, by the above methods, satisfactory shotshell casings having a basewad depth ranging between 0.038" to 0.0350". When increased volume is needed, we utilize a casing having a basewad height as low as 0.090". The thickness of such tubing has varied between 0.012" to 0.039", depending upon properties desired, the preferred thickness being approximately 0.022". Such tubing has straight walls of uniform thickness and internal and external diameters and has been biaxially oriented in a uniform manner throughout its length and has an $R_L$ value of approximately 4.365–8.150 and an $R_C$ value of approximately 1.056–1.219.

Despite the shrinkback of the softened end portion of such tubing as described herein, we find that the base sections retain their biaxial orientation to a substantial degree, and as a consequence, we can produce and utilize basewads of substantially lesser height. This provides increased volume capacity in the shotshell casing, a feature which has become of increased significance of late because of the usage of steel shot.

FIG. 1 shows a section of biaxially oriented tubing of such crystalline plastic cut to a predetermined length which is preferably approximately 2" longer than the standard length shell. The orientation is uniform throughout its length, and its sidewalls are of uniform thickness throughout. It may be manufactured in accordance with the Covington U.S. Pat. No. 3,103,170, or Diedrich U.S. Pat. No. 2,961,711, or it may be the Reifenhauser type well known in the trade, the latter having been uniformly stretched substantially, both axially and circumferentially during its manufacture.

As shown, the selected tube 70 is supported by a punch 71 and has a dollup 72 formed at its extreme upper end. This dollup 72 is produced by heating only the upper 0.093" of the tubing at any time, the heat being narrowly directed and confined to that area for approximately 15 seconds. We prefer to utilize an eliptical Infrared Line Heater of the Model 5212 type produced and sold by Research, Inc. of Minneapolis, Minnesota, U.S.A. Hot glycol and electric heating elements are examples of other means of heating which may be used.

It will be noted that the dollup 72 is of substantially thickened radial dimensions and that its diameter is less than that of the rigid walls 75 of the tube 70. This occurs, because upon heating, the inherent memory of the polymeric material causes the material to tend to shrinkback toward its original dimensions. We obtain the dollup by maintaining the source of heat at the same elevation above the upper end of the tube 70 at all times. In other words, we progressively lower the source of heat as the dollup is formed so that the temperature of the softened material will remain at approximately 375° F. at all times.

Figure 2:
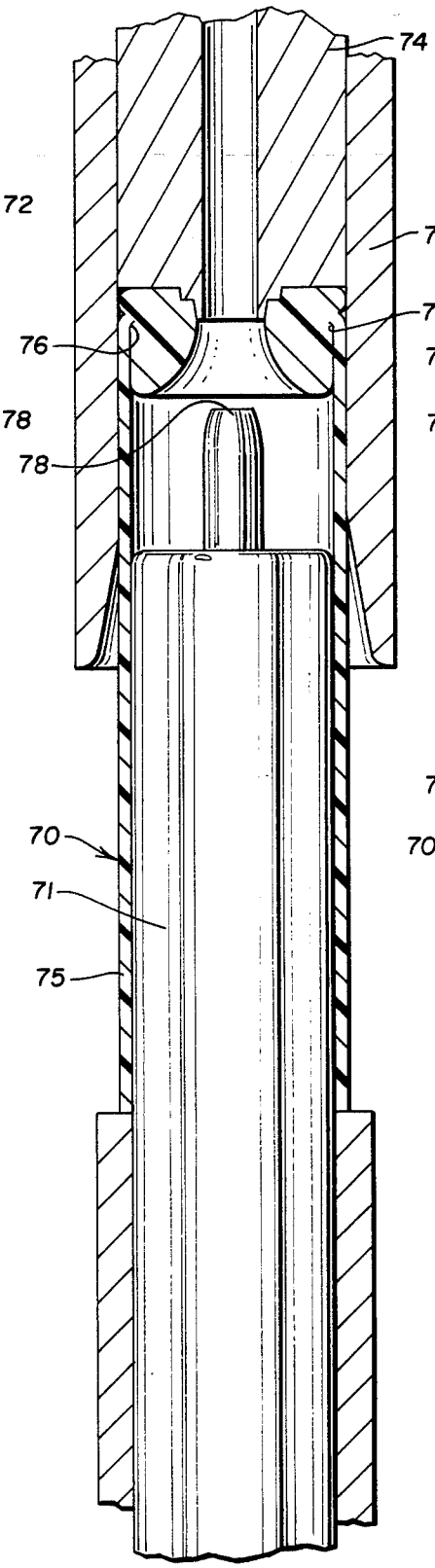
FIG. 2 is a vertical sectional view of a pair of die members cooperating to partially telescope the dollup of FIG. 1 within the rigid supporting sidewalls of the tube.

FIG. 2 shows the tube 7 inserted within external die 73 which cooperates with internal die 74 to force the major portion of the dollup inwardly within the rigid sidewalls 75 of the tube. It will be noted that the upper end of the supporting rigid walls 75 terminates at 76, which is a substantial distance inwardly of the upper end of the dollup, or the lower end of the die 74. We prefer to utilize sufficient materials so as to provide a base section as shown, of approximately 0.30" and the actual dimensions of the telescoped portion of the dollup is approximately 0.180", which leaves a non-telescoped portion having axial dimensions of approximately 0.120".

Figure 3:
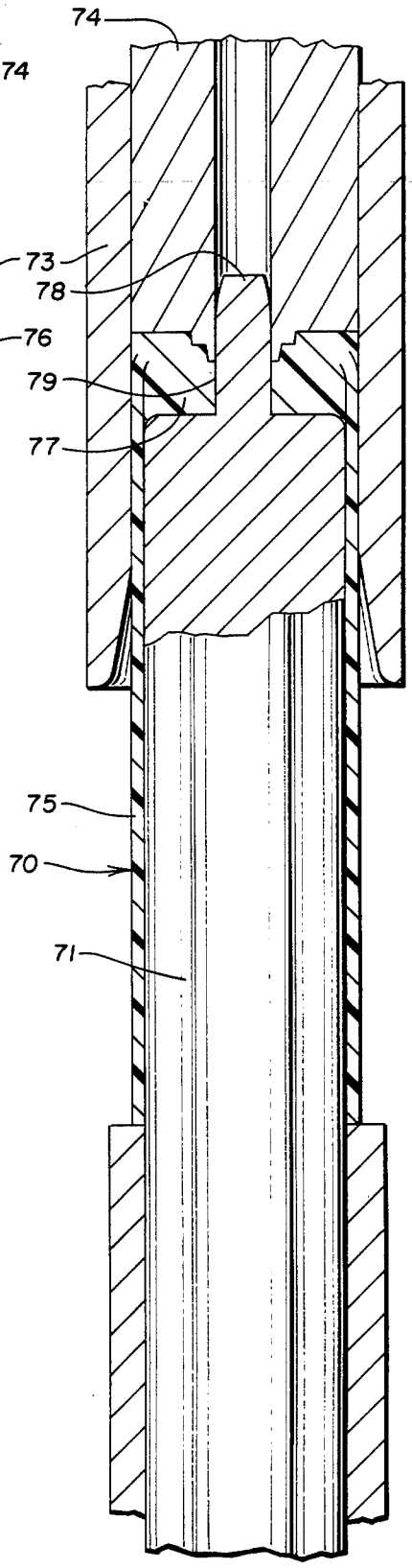
FIG. 3 is a vertical sectional view showing the two dies of FIG. 2 cooperating with the punch to form the entire dollup into a basewwad.

FIG. 3 shows the punch 71 cooperating with the outer die 73 and the inner die 74 to form the softened dollup into a transverse base section 77 which is integral with the rigid sidewalls 75 of the tube 70. Pin 78 of the punch 71 extends inwardly into the bore of the inner die 74 to form a primer opening 79 within the transverse base section 77. The temperature of the die is approximately 100°–180° F. and the basewad 77 is formed at pressures approximating 800–1000 p.s.i. The die clearances utilized are approximately 0.0004" to 0.005". The thickness of the wall tubing may approximate 0.012" to 0.039".

Figure 4:
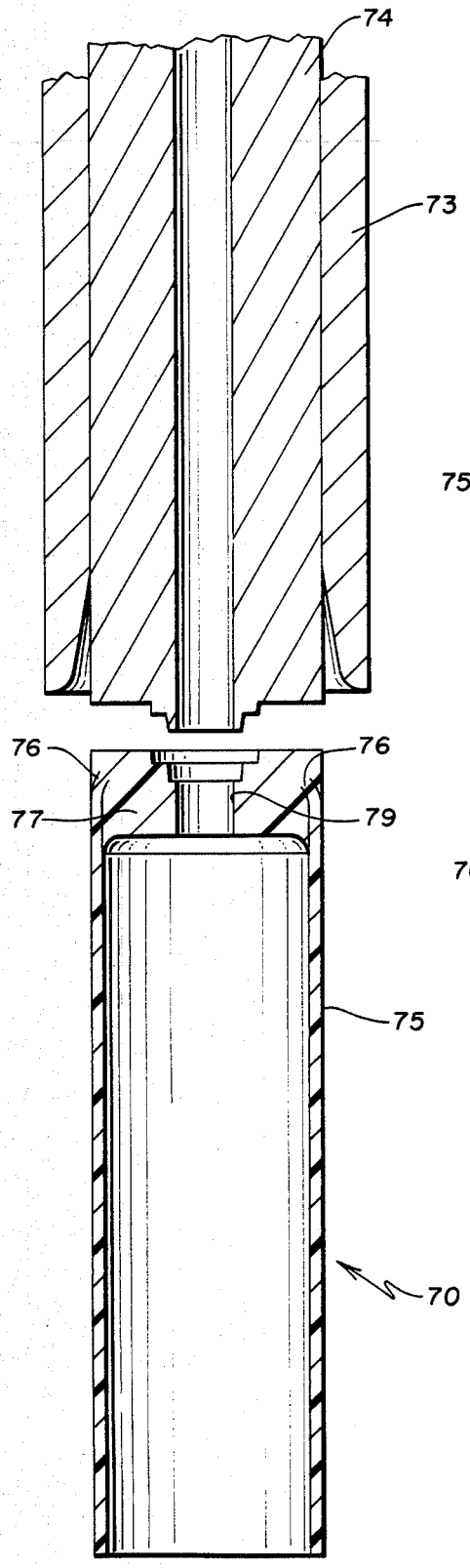
FIG. 4 is a vertical sectional view of the interior die member of FIG. 3 ejecting the finished casing.

FIG. 4 shows the inner die 74 ejecting the casing or tube 70 with its transverse base section 77 by descending within die 73 after punch 71 has been withdrawn.

Figure 5:
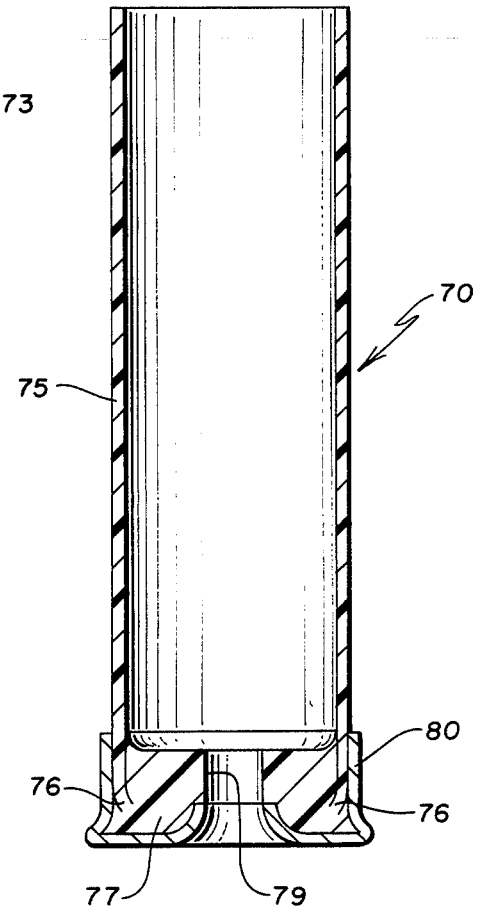
FIG. 5 is a vertical sectional view of the casing of FIG. 4 with a metal head applied thereto.

FIG. 5 shows the casing after metal head 80 has been applied thereto to cause the outer end portion of the non-telescoped portion of the basewad to extend radially outwardly into the rim of the metal head 80.

The method described above produces a one-piece plastic casing having an integral basewad which precludes the passage of the hot high pressure gases generated by firing into the rim portion of the metal head 80. In this manner, failure of the rim portion of the metal head is precluded and the need for resizing of the rim as a result of distortion from such gases is obviated. In addition, we find that the non-telescoped portion of the basewad effectively precludes any tendency of the tube 70 to increase or grow in length. As a result, we have eliminated two serious difficulties heretofore experienced in the manufacture of such casings without any substantial loss of any other desirable features of such a shotshell. Such a casing, as shown and claimed herein, has unusually strong sidewalls and basewad since each of them are substantially biaxially oriented after the forming operation and, consequently, are much stronger than thermoplastic casings made by other methods. Such a casing can be effectively reloaded many times with a consequent substantial saving to the shooter.

In considering this invention, it should be remembered that the present disclosure is illustrative only and the scope of the invention should be determined by the appended claims.

We claim:

1. A single-piece plastic shotshell casing comprising:
(a) an elongated tubular body comprised of biaxially oriented thermoplastic material throughout;
(b) said body having wall structure with inner surfaces and having sidewalls terminating at one of its ends in an integral substantially thickened biaxially oriented transverse base section formed from a length thereof with a centrally disposed axially extending primer opening therein, and supporting the same;
(c) said transverse base section contituting an integral internally homogenous base wad and being only partially telescoped axially inwardly in contiguous relation with said inner surfaces within said supporting sidewalls and being devoid of internal physical boundaries.

2. The structure defined in claim 1 in which at least the major portion of said base section is telescoped axially inwardly within said supporting sidewalls.

3. The structure defined in claim 1 in which at least the major portion of said transverse base section is telescoped axially inwardly within said supporting sidewalls and in which a radially outwardly extending annular flange is carried by said base section at its outer end.

4. The structure defined in claim 1 in which said sidewalls are of uniform internal and external diameters throughout their entire length.

5. The structure defined in claim 1 in which said transverse base section is only partially telescoped axially inwardly within said supporting sidewalls and in which the non-telescoped portions of said base section constitutes aproximately 40% of the body thereof.

6. The structure defined in claim 1 in which said transverse base section is only partially telescoped axially inwardly within said supporting sidewalls and in which the nontelescoped portion of said base section extends axially outwardly beyond the confines of said supporting sidewalls at least 0.120 inches.

7. The structure defined in claim 1 in which only a major portion of said transverse base section is telescoped axially inwardly within said supporting sidewalls.

8. The structure defined in claim 1 in which only a major portion of said transverse base section is telescoped axially inwardly within said supporting sidewalls and in which some of the non-telescoped portions of said base section extends radially outwardly beyond the confines of said supporting sidewalls.

9. The structure defined in claim 1 in which the axial dimensions of the telescoped portions of said base section are at least 0.180 inches.

10. The structure defined in claim 1 in which the axial dimensions of the non-telescoped portion of said transverse base section approximates 0.120 inches.

11. The structure defined in claim 1 in which the axial dimensions of the non-telescoped portion of said transverse base section approximates 0.120 inches and the telescoped portion thereof approximates 0.180 inches.

* * * * *